United States Patent [19]

Ukai

[11] Patent Number: 4,936,210

[45] Date of Patent: Jun. 26, 1990

[54] ARRANGEMENT OF PRINTING PINS IN A SERIAL TYPE DOT PRINTER

[75] Inventor: Makoto Ukai, Kanagawa, Japan

[73] Assignee: Kabushiki Kaisha Toshiba, Kawasaki, Japan

[21] Appl. No.: 240,477

[22] Filed: Sep. 6, 1988

Related U.S. Application Data

[63] Continuation of Ser. No. 934,839, Nov. 25, 1986, abandoned.

[30] Foreign Application Priority Data

Dec. 23, 1985 [JP] Japan ..... 60-287865

[51] Int. Cl.[5] ..... B41J 3/12

[52] U.S. Cl. ..... 101/93.04; 400/121

[58] Field of Search ..... 400/121, 124; 101/93.04, 93.05

[56] References Cited

U.S. PATENT DOCUMENTS

| | | | |
|---|---|---|---|
| 4,071,130 | 1/1978 | Lichti | 101/93.05 X |
| 4,278,021 | 7/1981 | Nakano | 101/93.29 |
| 4,408,907 | 10/1983 | Bernardis | 400/124 |
| 4,527,469 | 7/1985 | Wolf et al. | 101/93.04 |

FOREIGN PATENT DOCUMENTS

| | | | |
|---|---|---|---|
| 107502 | 5/1984 | European Pat. Off. | 400/121 |
| 51-131721 | 5/1975 | Japan | 400/124 |
| 110254 | 6/1983 | Japan | 400/121 |
| 60-139460 | 7/1985 | Japan | 400/121 |

*Primary Examiner*—David A. Wiecking

*Attorney, Agent, or Firm*—Foley & Lardner, Schwartz, Jeffery, Schwaab, Mack, Blumenthal & Evans

[57] ABSTRACT

In the present invention there is disclosed an improved serial type dot printer. According to the printer, the mutual magnetic interference between the magnetic circuits that are provided for each of the printing hammers to act as their respective driving sources, can be avoided by an appropriate choice of the distance between the printing pins, and at the same time, the power supply capacity can be reduced.

3 Claims, 6 Drawing Sheets

ARRANGEMENT OF PRINTING PINS IN A SERIAL TYPE DOT PRINTER

This application is a continuation of application Ser. No. 934,839, filed Nov. 25, 1986, now abandoned.

BACKGROUND OF THE INVENTION

1. Field of the Invention

The present invention relates to a serial type dot printer for printing letters with dot matrix configuration.

Heretofore, in a dot matrix printer that is used for the output of a word processor or the like, the 24-dot type which constitutes one letter with a dot matrix of 24 rows × 24 columns has been occupying the mainstream. In recent years, however, there has been an increasing demand for higher density in an attempt to elevating the quality of printing by this method such as the outputting of chinese characters close to the quality obtainable by the use of the types.

With this in mind, there is desired manufacture of a high density printer that has a denser construction than 24 × 24 for one letter, for the same size of the letter as before. However, due to the reasons that will be given below, realizing a high density has been difficult to achieve for a wire dot type serial printer or a dot type line printer.

Namely, the wire dot type serial printer has a construction in which printing wires of as many as 24 are concentrated in a very small space of the printing surface Because of this, the printing wire has to be bent by the use of a guide or the like, from the junction surface between the driving unit that is arranged, for example, in a circular form and the printing wire to the printing surface Further, in a very narrow space in the junction surface between the driving unit and the printing wire, the printing wires have to be attached to the driving unit by such a method as soldering so as not to make a contact with the neighboring wires. Accordingly, to increase the density of the printing dots without changing the size for one letter, the thickness of the printing wires has to be decreased. However, with such a reduced diameter, the printing wires of the existing type tend to be broken due, for example, to the impact at the time of printing reducing the reliability of the printing. Moreover, junction of a large number 24 printing wires and driving units in a very narrow space in the junction surface is technically difficult to achieve. As in the above, manufacture of a printing head which permits a high density printing has been difficult from the viewpoint of reliability, manufacturability, and so forth.

For this reason, a dot type line printer that can carry out printing without the printing wires was developed. In this printer, short printing pins that are attached to a printing hammer are arranged linearly with equal separation in the direction perpendicular to the direction of motion of the printing medium over the length equal to the width of the printing medium. Then, one dot line is printed on a printing medium by rocking a hammer base, that has hammers mounted on it for the length of a pitch to the adjacent printing pin, under the driving of each hammer with appropriately coordinated timings. After completion of printing for one dot line, the printing for the next dot line is carried out by shifting the printing medium for a distance which is equal to one dot pitch in the direction perpendicular to the dot line, and by repeating the driving of the hammer base in the same manner as in the above. Since short printing pins instead of wires may be employed for this type of printer, it is only necessary to reduce the diameter of the tip of the printing pins in order to achieve high density However, this type of printer requires a large number of hammers which necessitates in turn a power supply with large capacity In addition, a large special type of driving device is also needed to rock a hammer base that has hammers attached to it. These lead to disadvantages that the printer is high in cost and large in size.

In contrast, in Japanese Patent No. 60-139460 there is disclosed an improved serial type dot printer. In this printer, printing pins are arranged on a straight line that has an inclination of a fixed angle with respect to the scanning direction of the printing mechanism. Further, for driving the printing pins there are provided flat springs corresponding to the printing pins, disposed alternately in up and down fashion, without using wires and without requiring numerous hammers and a special rocking device, as are required in the line printer.

However, in a dot printer of this kind, printed letters are constructed by dot matrix so that there frequently occur cases in which neighboring hammers are driven at the same time. When the magnetic circuits for driving hammers that are attached to the neighboring hammers are excited simultaneously, there is generated a magnetic interference, giving rise to a problem of miscoordination in the timing of printing.

SUMMARY OF THE INVENTION

An object of the present invention is to provide a serial type dot printer which enables an exact printing of high quality.

Another object of the present invention is to provide a serial type dot printer in which the magnetic circuits for the printing hammers will not give rise to a magnetic interference between the neighboring circuits.

Another object of the present invention is to provide a serial type dot printer which can be driven by a driving circuit with a small power supply capacity.

PREFERRED EMBODIMENTS OF THE INVENTION

Referring to the figures, an embodiment of the present invention will be described in the following.

Figure 1A:
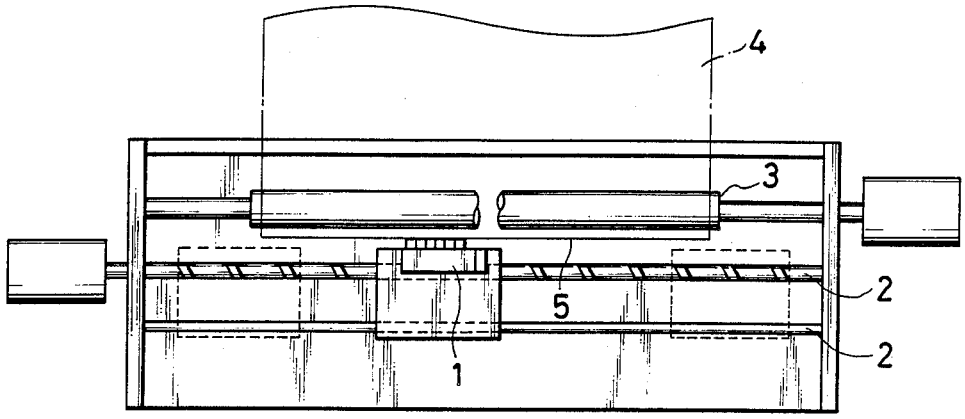
FIG. 1 (A) and FIG. 1 (B) are a schematic plan view and a front view, respectively, of a printer in accordance with an embodiment of the present invention.
Figure 1B:
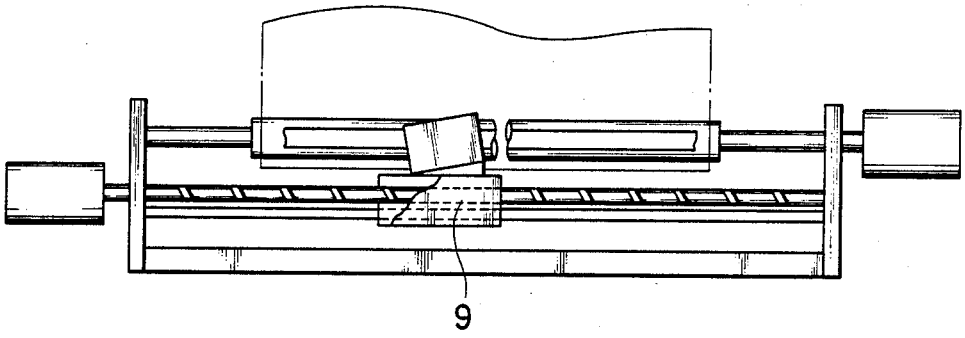

FIG. 1 (A) and FIG. 1 (B) are a schematic plan view and a side view of a printer in accordance an embodiment of the present invention.

In the figures, the printing head 1 is mounted on a carriage 9, and the carriage 9 is moved on the guide rails by a motor or the like which is not shown, back and forth within the limits shown by the dotted squares whose separation is greater than the width of the printing paper 4. By coordinating timing with the motion of the carriage 9, each printing hammer which is not shown and attached to the printing head 1 is driven, and printing is carried out on the printing paper 4 which is pressed against a platen 3 via an ink ribbon 5. After one line of printing is completed, the direction of motion of the carriage 9 is reversed, and the printing for the next line is carried out by forwarding the printing paper 4 for a space of one line.

Figure 2:
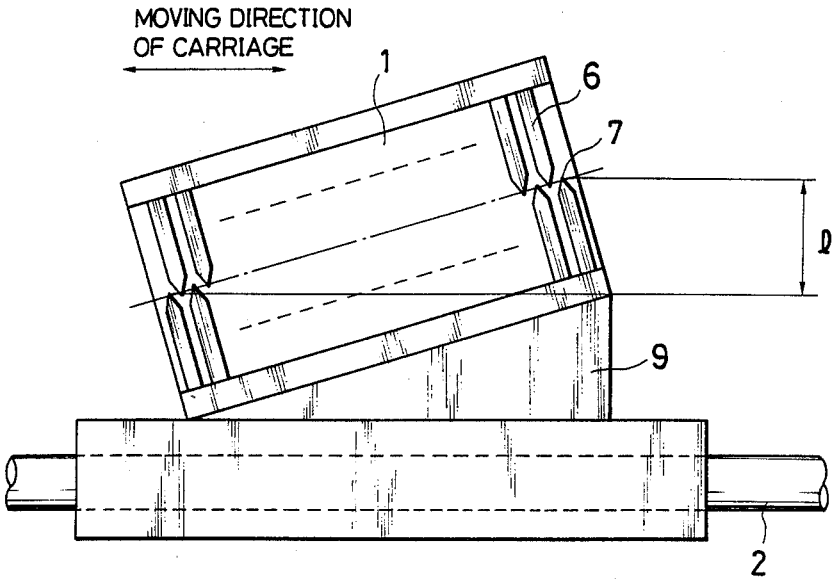
FIG. 2 and FIG. 3 are a front view and a side view, respectively, that show the structure of the principle of the printing head for the printer in accordance with the embodiment of the present invention shown in FIG. 1.
Figure 3:
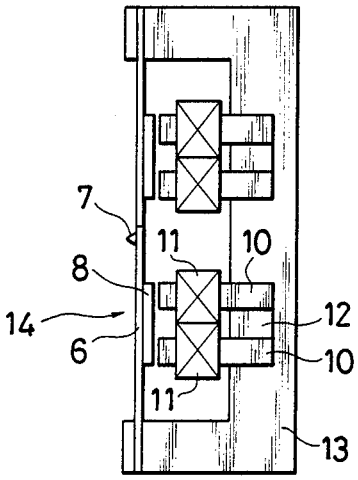

FIG. 2 and FIG. 3 are a front view and a side view which show the principle of the printing head of the printer in accordance with the embodiment shown in FIG. 1.

A printing hammer 14 consists of a flat spring 6, a printing pin 7, and an armature 8 made of a magnetic material which is attached to the flat spring 6 by soldering or the like in order to form a magnetic circuit. The operation of the printing hammer 14 is as follows. First, the printing hammer 14 is held on the end surface of the iron core 10 of a permanent magnet 12 by the attracting force of the magnet, against the spring force of the flat spring 6. Then, printing is carried out by passing a current in a coil 11 to cancel the magnetic field of the permanent magnet 12 and let the printing hammer 14 move toward an ink ribbon tape that is not shown, by means of the spring force of the flat spring 6.

As shown in FIG. 2, the printing pins 7 of the printing hammer that carries out the above operation are arranged on a straight line with equal spacing and disposed up and down in alternating fashion. As a result, the pitch between the printing pins 7 can be made small and the space for the iron core 10 and the coil 11 can be secured, so that the width of the printing head 1 can be made small, realizing a small-sized printing head. The printing head 1 is attached to the carriage 9 tilted by an angle so as to have the separation l between the printing pins that are on both ends corresponds to one letter as shown in FIG. 2. Printing is carried out by driving each printing hammer while the carriage 9 moves from one end to the other of the printing paper 4.

Figure 4:
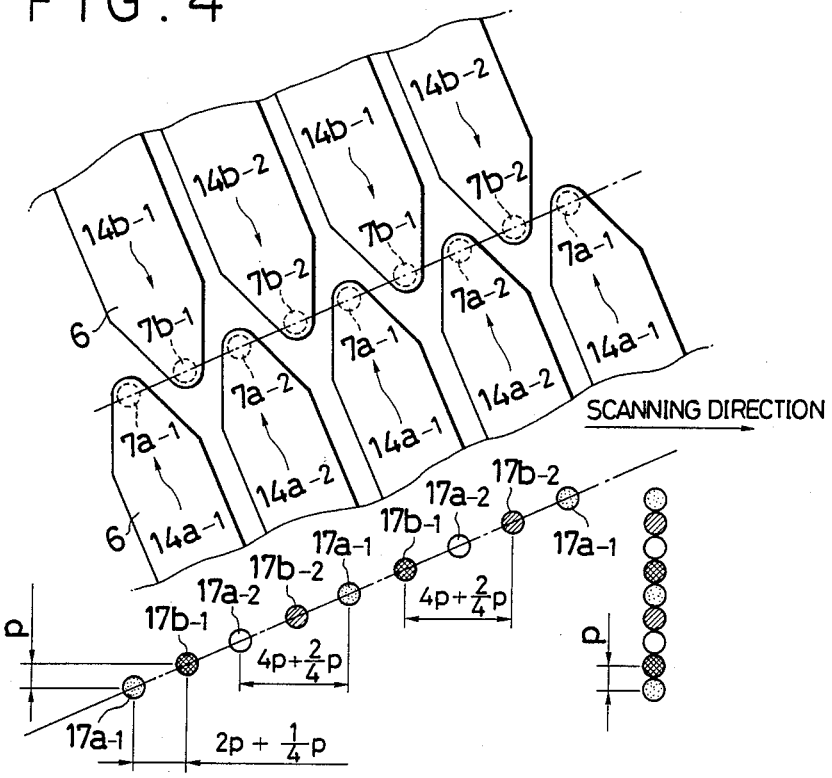
FIG. 4 is a plan view which shows the relationship between the disposition of the printing pins and the printing dots of the printer in accordance with the embodiment of the present invention shown in FIG. 1.
Figure 5:
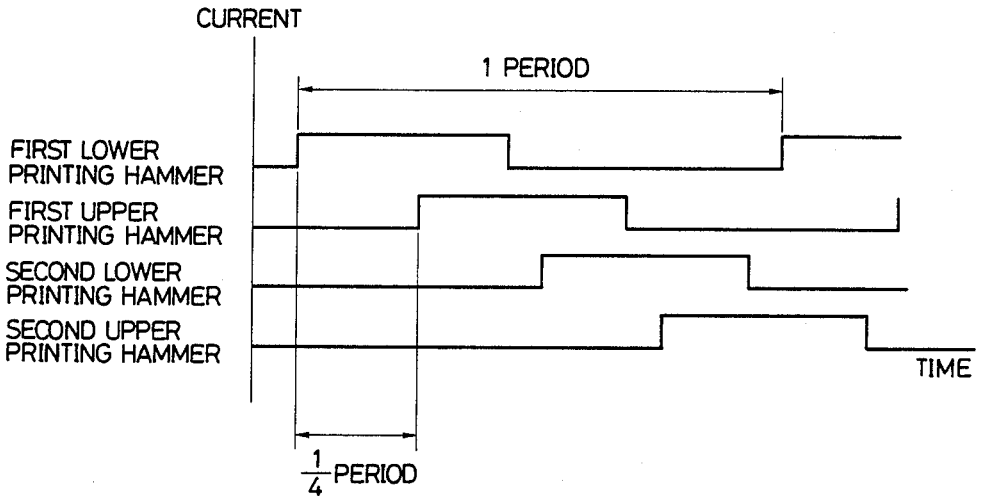
FIG. 5 is a diagram for showing the driving timings of the printing hammers of the printer in accordance with the embodiment of the present invention shown in FIG. 4.
Figure 6:
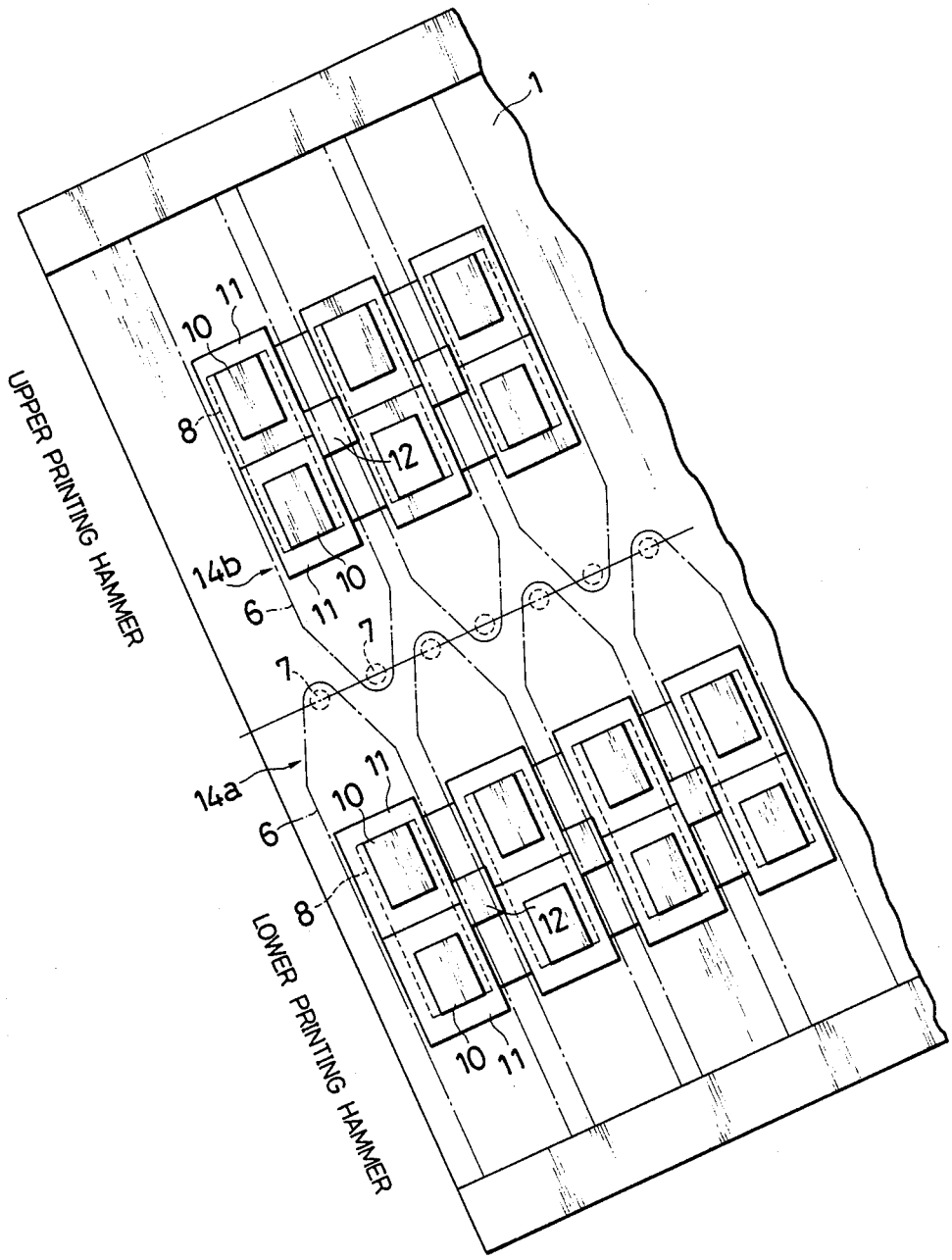
FIG. 6 is a plan view for showing the construction of the printing head in accordance with the present invention.

Next, in FIG. 4 to FIG. 6, there are shown the relationship between the disposition of the printing pins 7 and the disposition of the printed letters of the printing dots 17, and the driving timings for these components.

In FIG. 4, the printing pins are arranged so as to have the pitch of the pins in the scanning direction of each of the adjacent printing pins 7a-1 and 7b-1, 7b-1 and 7a-2, 7a-2 and 7b-2, and 7b-2 and 7a-1 to be (2p+p/4) where p is the pitch of the dots. In addition, the printing hammers 14 with printing pins 7 attached on are installed in a manner alternating for the upper and lower ones. Therefore, if they are called successively, starting with the bottom end of the tilted head 1, first lower printing hammer 14a-1, first upper printing hammer 14b-1, second lower printing hammer 14a-2, and second upper printing hammer 14b-2, then the printing pins 7a-1, 7a-2 and 7b-1, 7b-2 that are attached to the adjacently disposed first lower printing hammer 14a-1, second lower printing hammer 14a-2 and first upper printing hammer 14b-1, second upper printing hammer 14b-2, respectively, have a pin pitch in the scanning direction that is (4p+2p/4) where p is the dot pitch. In the lower part of FIG. 4 there are shown printing dots 17a-1, 17b-1, 17a-2, and 17b-2 that correspond to the printing pins from 7a-1 to 7b-2.

FIG. 5 illustrates the timings for driving each of the first lower printing hammer 14a-1 up to the second upper printing hammer 14b-2. The ordinate is the current that is supplied to the magnetic circuit of the printing hammer 14 and the abscissa is the time. As the scales of the time axis, examples of average values for the currently available printers, namely, a period of 700 [μs] for the printing hammer 14 and a duration of 300 [μ] for current application have been employed. In addition, as shown in FIG. 5, starting with the printing hammer which is next to the first lower printing hammer 14a-1, each of the succeeding printing hammer, up to the second upper printing hammer 14b-2, is operating with a timing which is shifted by one quarter of a period from the previous printing hammer.

This means that the second lower printing hammer 14a-2 is driven after the completion of the driving for the first lower printing hammer 14a-1. In other words, the magnetic circuit formed by the armature 8, iron core 10, coil 11, and permanent magnet 12 for the adjacently situated first lower printing hammer 14a-1 and the second lower printing hammer 14a-2 as shown in FIG. 6 will not be excited simultaneously. Analogously, the magnetic circuits for the adjacent first upper printing hammer 14b-1 and the second upper printing hammer 14b-2 will not be excited simultaneously. Therefore, no magnetic interference will be generated between the adjacent printing hammers 14 so that there can be obtained a high quality printing with exact timing for printing and at the same time the power supply capacity can be reduced.

It should be noted that it is possible in similar manner to eliminate the magnetic interference and reduce the power supply capacity by arranging the printing hammers 14 so as to have the pin pitch in the scanning direction, between the printing pins that are attached to the adjacent printing hammers 14 that have magnetic circuits, to be (N+2/X) times the pitch of the printing dots (where N is zero or a positive integer and X is a positive integer greater than or equal to 4), and by regulating the printing period of the printing hammers 14 and the durations of application of the currents to the magnetic circuits.

Next, referring to FIG. 7 and FIG. 8, another embodiment of the present invention will be described.

Figure 7:
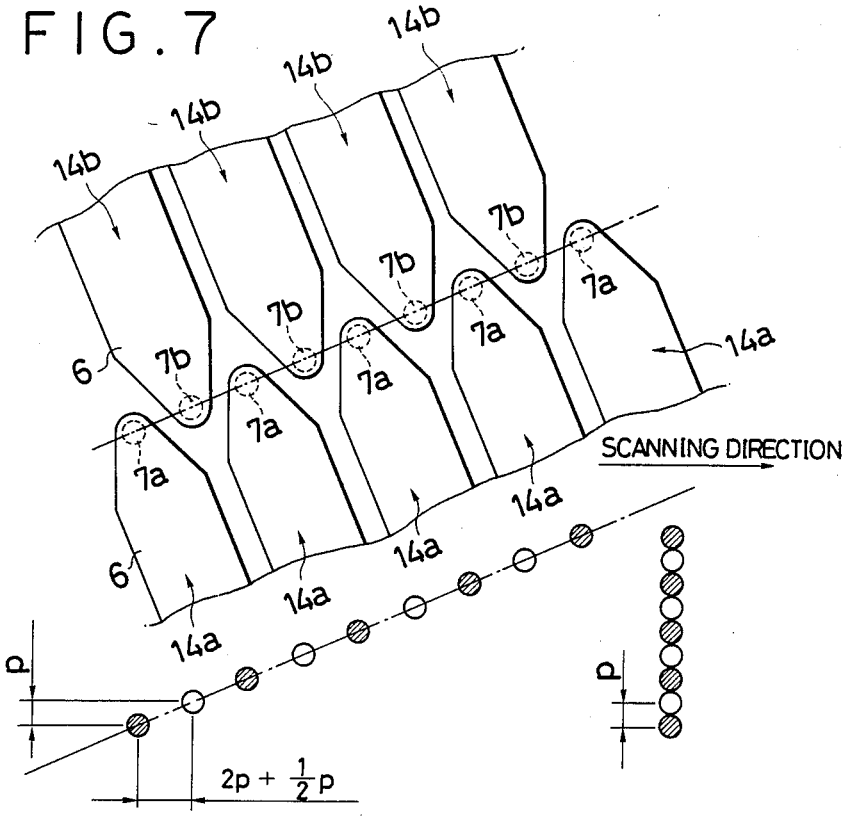
FIG. 7 is a plan view which shows the relationship between the disposition of the printing pins and the printing dots of the printer in accordance with another embodiment of the present invention.

In FIG. 7, the adjacent printing pins *7a*, *7b* and *7b*, *7a* are arranged so as to have the pin pitch in the scanning direction to be, for example, (2P+P/2) where P is the dot pitch.

Figure 8:
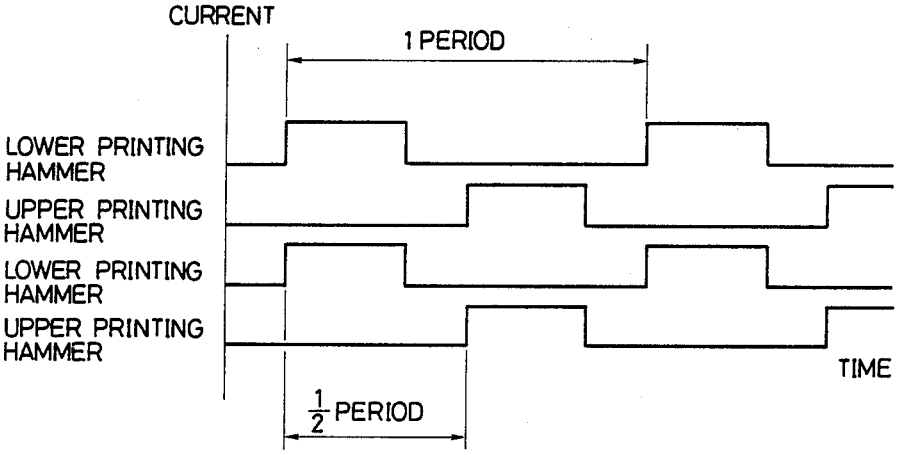
FIG. 8 is a diagram for showing the driving timings of the printing hammers of the printer in accordance with the embodiment of the present invention shown in FIG. 7.

In FIG. 8 are shown the driving timings for each of the lower printing hammers 14a and the upper printing hammers 14b. Similar to FIG. 5, the ordinate shows the current to be applied to the magnetic circuit of the printing hammer 14, and the abscissa shows the time. As may be clear from FIG. 8, the lower printing hammer 14a and the upper printing hammer 14b are operated with a timing which has a mutual shift of one half of a period. Accordingly, by arranging the adjacent printing pins so as to have the pin pitch in the scanning direction to be, for example, $(N+\frac{1}{2})$ times the dot pitch p, the number of printing hammers that operate simultaneously may be reduced to one half, and the power supply capacity also to one half.

With the same principle, by arranging the printing pins so as to have the pin pitch in the scanning direction to be $(N+1/X)$ times the dot pitch p (where N is zero or a positive integer and X is a positive integer which is equal to or greater than 2) it is possible to reduce the number of printing hammers that operate simultaneously to 1/X and the power supply capacity to 1/X.

Next, referring to FIG. 9 and FIG. 10, still another embodiment of the present invention will be described.

Here, identical or corresponding components to those in FIG. 1 to FIG. 8 will be omitted from the figures.

Figure 9A:
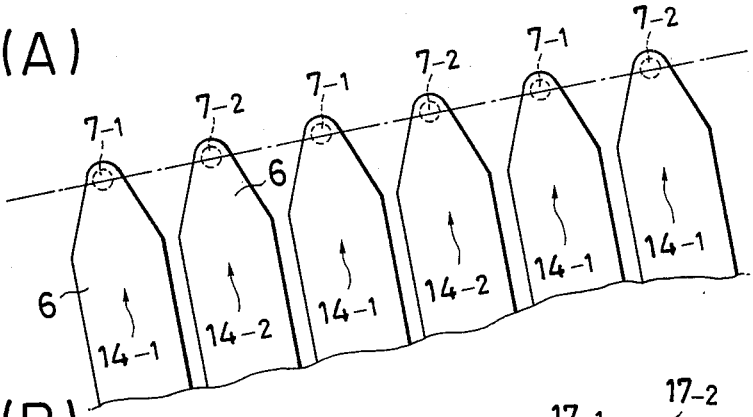
FIGS. 9A and 9B respectively illustrate a plan view for showing the relationship between the printing pins and the printing dots of the printer in accordance with still another embodiment of the present invention.
Figure 9B:
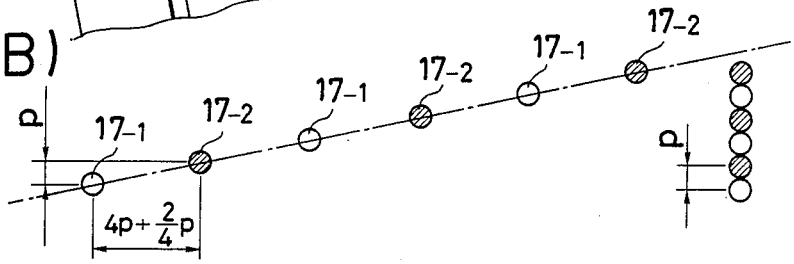

In FIG. 9 is shown the case in which they are arranged, for instance, on the lower side alone, instead of the alternating arrangement on the upper and lower sides as in the previous embodiments. In the figure, the printing hammers are arranged so as to have the pin pitch in the scanning direction of the printing pins 7-1 and 7-2, that are attached to the printing hammers 14-1 and 14-2, respectively, that have adjacent magnetic circuits, to be $(4p+2p/4)$ where p is the dot pitch that is, $(N+2/X)$ times the printing dot pitch P (where N is zero or a positive integer, and X is an integer equal to or greater than 4). The construction, action, and effects of this embodiment are similar to the case in which the pin pitch in the scanning direction of the adjacent printing pins 7-1 and 7-2 is $(N+1/X)$ times the dot pitch P (where N is zero or a positive integer, and X is an integer equal to or greater than 4). The printing hammers from the bottom end of the tilt are called first printing hammer 14-1 and second printing hammer 14-2, and the corresponding printing dots are shown as 17-1 and 17-2, respectively, in FIG. 9 (B).

Figure 10:
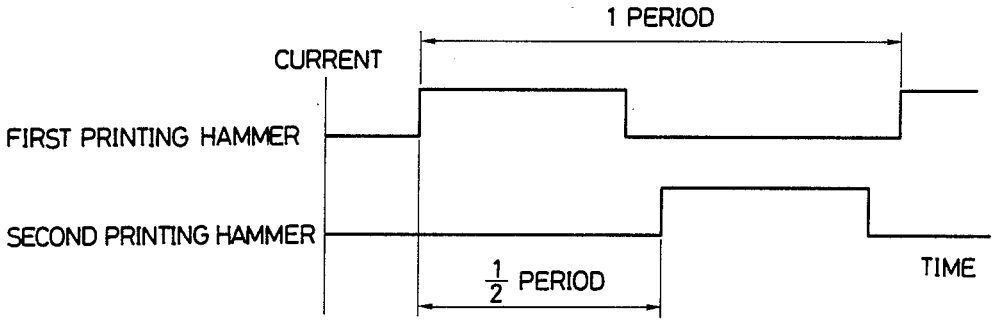
FIG. 10 is a diagram for showing the driving timings of the printing hammers in accordance with the embodiment shown in FIG. 9.

FIG. 10 shows the driving timings for the respective printing hammers 14-1 and 14-2. Analogous to FIG. 5, the ordinate shows the current that is applied to the printing hammer 14 and the abscissa shows the time.

As shown in FIG. 10, the first printing hammer 14-1 and the second printing hammer 14-2 are being operated with a mutual shift of one half of a period. This means that the second printing hammer 14-2 is driven after completion of the driving for the first printing hammer 14-1. In other words, the magnetic circuits (The circuit consists of an armature 8, iron core 10, coil 11, and permanent magnet 12. See FIG. 6.) for the first printing hammer 14-1 and the second printing hammer 14-2 will not be excited simultaneously. Therefore, no magnetic interference will occur between the adjacent printing hammers 14-1 and 14-2, so that a printing with high quality with an exact printing timing can be obtained, and at the same time, the power supply capacity can be reduced.

By arranging the printing hammers 14 so as to have the pin pitch in the scanning direction between the printing pins 7 that are attached to the printing hammers 14 that have adjacent magnetic circuits, to be $(N+2/X)$ times the dot pitch (where N is zero or a positive integer and X is an integer greater than or equal to 4), or the pin pitch in the scanning direction of the adjacent printing pins to be $(N+1/X)$ times the dot pitch P (where N is zero or a positive integer, and X is an integer equal to or greater than 2), and by regulating the printing period of the printing hammers 14 and the duration of application of the current to the magnetic circuits, it becomes possible analogous to the foregoing embodiment to eliminate magnetic interference.

Further, in the embodiments in the foregoing, printing pins were arranged on a straight line with a fixed tilt. However, it may also be arranged, for instance, on two straight lines instead of one.

Moreover, in the above embodiments, the magnetic circuit is given a construction in which the magnetic attractive force of the permanent magnet which attracts the flat spring 6 against its spring force, is canceled by the passing of a current in the coil 11.

However, printing may be arranged to be carried out by attracting the flat spring 6 by, for example, an electromagnet instead of a permanent magnet 12. In addition, various modifications will be possible without departing from the scope of the present invention.

What is claimed is:

1. A serial type dot printer for printing visual information which is composed of a plurality of dots separated by a dot pitch, said printer comprising:

a structure for holding a printing medium in a printing position;

a printing head adapted to move along said medium;

a plurality of printing hammers provided on said printing head;

a plurality of printing pins respectively attached to said printing hammers, said pins being arranged on a line tilted at a fixed angle with respect to a direction of motion of said printing head;

a plurality of magnetic circuits for driving said printing hammers, respectively, and wherein said printing hammers are arranged in two groups, each group extending toward said tilted line, along which said printing pins are disposed, from opposite directions in an alternating manner, wherein the printing pins of the two groups are separated, by a distance of $N+1/X)$ times the dot pitch, where N is a nonnegative integer and X is an integer equal to or greater than 2.

2. A serial type dot printer comprising:

a carriage adapted to move in a scanning direction;

a printing head including a plurality of printing hammers coupled to said carriage;

a plurality of printing pins respectively attached to said printing hammers and arranged obliquely with respect to the scanning direction;

a plurality of magnetic circuits corresponding to said printing hammers; and wherein said printing hammers are arranged in two groups, each group extending toward a tilted straight line, along which said printing pins are disposed, from opposite directions in an alternating manner, wherein the printing pins of the two groups are separated, by a distance of $(N+1/X)$ times the dot pitch, where N is a nonnegative integer and X is an integer equal to or greater than 2.

3. A serial type dot printer comprising:

a plurality of printing hammers;

printing pins attached to each of the printing hammers to be disposed obliquely at a fixed angle with respect to a scanning direction, wherein the distance between said printing pins that are adjacent with respect to the scanning direction is always a nonintegral multiple of the pitch width p of the printing dots during a printing operation, said printing hammers are arranged in two groups, each group extending toward a tilted straight line, along which said printing pins are disposed, from opposite directions in an alternating manner, and the printing pins of the two groups are separated, by a distance of $(N+1/X)$ times the dot pitch, where N is a nonnegative integer and X is an integer equal to or greater than 2; and a plurality of adjacently arranged magnetic circuits for respectively driving said printing hammers.

* * * * *